US006802392B1

(12) United States Patent
Davis

(10) Patent No.: US 6,802,392 B1
(45) Date of Patent: Oct. 12, 2004

(54) STOWING STAIRWAY

(76) Inventor: Gene S. Davis, N7551 Newville Rd., Waterloo, WI (US) 53594

( * ) Notice: Subject to any disclaimer, the term of this patent is extended or adjusted under 35 U.S.C. 154(b) by 0 days.

(21) Appl. No.: 10/397,649

(22) Filed: Mar. 25, 2003

(51) Int. Cl.[7] ..... E06C 9/00
(52) U.S. Cl. ..... 182/77; 182/78
(58) Field of Search ..... 182/77, 46, 78, 182/129, 178; 49/340

(56) References Cited

U.S. PATENT DOCUMENTS 1,344,371 A * 6/1920 Badger et al. ..... 182/78
1,867,904 A * 7/1932 Bessler ..... 182/78
3,575,405 A * 4/1971 Harding ..... 269/258
3,789,955 A * 2/1974 Knapp ..... 182/78
4,068,770 A * 1/1978 Boehringer ..... 414/537
4,202,119 A * 5/1980 Grace ..... 37/338
4,281,743 A 8/1981 Fuller
4,286,508 A * 9/1981 Seebo, II ..... 454/354
4,541,508 A * 9/1985 Lundh
5,626,440 A * 5/1997 Greene et al. ..... 405/218
5,850,891 A * 12/1998 Olms et al. ..... 182/127
2004/0020719 A1 * 2/2004 Kwak ..... 182/196

FOREIGN PATENT DOCUMENTS

JP 6-81567 * 3/1994 ..... 182/77

* cited by examiner

*Primary Examiner*—Bruce A. Lev
(74) *Attorney, Agent, or Firm*—Craig A. Fieschko, Esq.; Dewitt Ross & Stevens S.C.

(57) ABSTRACT

A stair is pivotable from a lowered position allowing a user to climb the stair from a lower level to an upper level, into a stowed position wherein the stair is lifted from the lower level so that the plane of the stair is approaches the ceiling situated between the lower and upper level. The stair, which is preferably not articulated (i.e., the stair does not fold), rotates between the lowered and stowed positions about a pivot fixed in association with the ceiling. A drive cable, which preferably extends from the stair top or from a drive arm extending from the stair top, is anchored to surrounding structure in the upper level. A drive motor drives the drive cable to draw the stair top downwardly, thereby raising the stair bottom about the pivot.

20 Claims, 1 Drawing Sheet

100
108
112
116
200
202
114
110
128
120
124
126
130
122
134
132
208
206
204
116
102
118
104
106
134

STOWING STAIRWAY

FIELD OF THE INVENTION

This disclosure concerns an invention relating generally to ladders and stairways which are collapsed or otherwise converted between an in-use state and a stowed or hidden state.

BACKGROUND OF THE INVENTION

Foldable stowing stairways, which may be folded upwardly into the ceiling or towards another elevated level or surface, are known from U.S. Pat. Nos. 4,281,743 and 4,541,508. Such foldable stowing stairways are advantageous because they allow a stair to be folded out of the way when space concerns are present, so that the stair no longer occupies floor space on the lower floor or other surface from which a user wishes to ascend. Such stairways essentially amount to articulated ladders wherein the siderails of the ladders are jointed to allow them to be folded up, and then the folded siderails may themselves be folded between opposing joists of a ceiling to fully stow the stairways.

Such stairways are unsatisfactory in several respects. First, the jointed/articulated nature of their siderails tends to make them lack rigidity, and they can be somewhat wobbly when a user climbs them. It is also often difficult for users to elevate their siderails to complete their folding, particularly if the user is short or lacks upper body strength. Additionally, apart from the difficulty and inconvenience of folding an articulated ladder, the articulated ladders also suffer from the disadvantage of more rapid wear (and inherently limited load capacity) owing to the weakness of the folding joints.

The invention, which is defined by the claims set forth at the end of this document, is directed to stowing stairways which at least partially alleviate the aforementioned problems. A basic understanding of some of the preferred features of the invention can be attained from the Detailed Description provided later in this document.

DETAILED DESCRIPTION OF PREFERRED VERSIONS OF THE INVENTION

Figure 1:
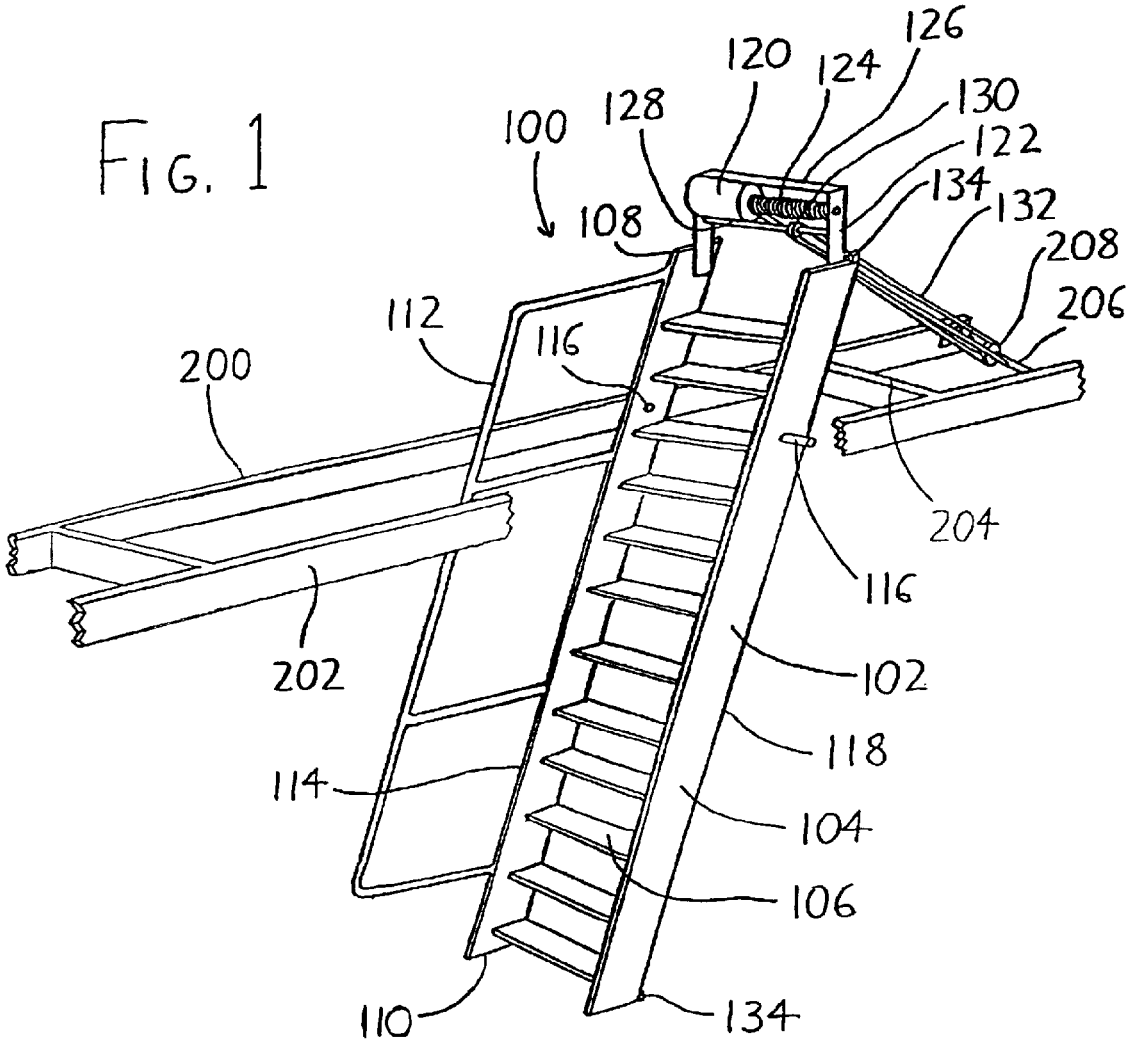
FIG. 1 is a perspective view of an exemplary version of a stowing stair 100 in accordance with the invention, depicting a stair 102 in a lowered state, with the stair 102 being rotatably connected to framing 200 situated between a lower level (i.e., a lower floor) and an upper level (i.e., an upper floor) at a pivot 116.

Turning to FIG. 1, a preferred version of the invention is depicted by the reference numeral 100. The stowing stair 100 includes a stair 102 having a pair of parallel opposing stair siderails 104, and a series of stair rungs 106 extending between the stair siderails 104 between a stair top 108 and a stair bottom 110. The stair rungs 106 are preferably spaced at regular intervals along the stair siderails 104, and are preferably aligned such that when the stair bottom 110 rests on the surface of a lower level (e.g., a lower floor), the top surfaces of the stair rungs 106 are parallel to the ground to provide at least substantially horizontal surfaces onto which a user may step. The stair 102 preferably has the gradient of an ordinary stairway (as dictated by local building codes), though it may have a steeper or more gradual gradient as desired. Railings 112 are also preferably provided at a location spaced from and parallel to the stair siderails 104. Thus, a user approaching the front side 114 of the stair 102 may climb the stair rungs 106 from the lower level beneath the stair bottom 110 to reach an upper level (e.g., an upper floor such as an attic) adjacent the stair top 108, with the upper level being defined by the framing 200. Such framing 200 will generally be formed of the floor joists or other framework defining the upper level, with the framing 200 of FIG. 1 including opposing framing sides 202 (which might take the form of attic floor joists), and sills 204 inserted therebetween. It should be understood that the framing 200 will generally have plywood, particle board, or some other flooring surface installed about its top surfaces to define a floor for the upper level, and the framing 200 will also generally have drywall or some other ceiling surface provided on its lower surfaces to define a ceiling for the lower level.

The stair 102 bears a pivot 116 by which the stair 102 may rotate between a lowered, in-use position such as the one illustrated in FIG. 1, and a stowed position wherein the stair bottom 110 is raised to a level at or near the upper level and its framing 200, with the rear side 118 of the stair 102 preferably being flush with any ceiling surface provided on the lower side of the framing 200. When the stair 102 is rotated to its stowed position, the stair bottom 110 will be raised, and the stair top 108 will be lowered, in relation to the lower level until the stair top 108 and stair bottom 110 rest adjacent the opposing sills 204 of the framing 200.

The pivot 116 of the stowing stair 100 is depicted in the simple form of rods which protrude outwardly from the stair siderails 104, and which then extend within complementary apertures in the framing 200 so that they rotate therein in journalled fashion. This form of pivot 116 may be easily implemented by merely providing metal rods protruding outwardly from the stair rungs 106, and which protrude into holes drilled within the framing 200 (with such drilled holes preferably being reinforced with metal rims, as by reinforcing the hole drilled in the framing 200 with a metal plate having a hole drilled therein).

The pivot 116 is preferably situated near the stair top 108, and is most preferably spaced from the stair top 108 by one or more stair rungs 106, so that the stair 102 has a length extending upwardly above the framing 200 when the stair 102 is in its fully lowered position with the stair bottom 110 resting on the lower level. Since the pivot 116 is spaced closer to the stair top 108 than the stair bottom 110, a greater portion of the weight of the stair 102 will be distributed below the pivot 116 (i.e., on the side of the stair 102 closer to the stair bottom 110). Thus, absent some opposing force, the stair 102 will be normally biased by gravity to have its stair bottom 110 resting on the lower level (i.e., the stair 102 is ordinarily biased towards its lowered position absent an opposing force).

A drive motor 120 is then provided to drive the stair 102 about the pivot 116 between its lowered and stowed positions. The drive motor 120 is preferably situated adjacent the stair top 108 between a pair of drive arms 122, which each have one end affixed to the stair top 108 and which have the drive motor 120 mounted at their opposing ends. The drive motor 120, which is preferably a standard hoist/winch motor which has a protruding winding rotor 124 and which operates on standard household currents and voltages, has the drive motor 120 affixed to one of the drive arms 122 and has the winding rotor 124 rotatably supported by the other drive arm 122 (as by having the end of the winding rotor 124 journalled within this drive arm 122). A drive arm bridge 126 is shown extending between the drive arms 122 at a location spaced from the stair top 108 (e.g., above and/or below the drive motor 120) to lend rigidity to the drive arm 122/drive motor 120 subassembly. A drive arm rod 128 is also depicted below the drive motor 120 and extending between the drive arms 122, with a drive arm pulley 130 rotatably situated on the drive arm rod 128.

A non-rotating anchor rod 206, which also has a anchor rod pulley 208 rotatably situated thereon, is provided between the framing sides 202 at points spaced from the pivot 116 and the stair top 108 (i.e., spaced from the top sill 204). A drive cable 132 is then affixed to the anchor rod 206. The drive cable 132 extends from the anchor rod 206 at which it is anchored, upwardly toward the drive motor 120 and about the rotatable drive arm pulley 130, then back down towards the anchor rod 206 and about the rotatable anchor rod pulley 208, and then upwardly to the drive motor 120, where the drive cable 132 is wound about (and ultimately affixed to) the winding rotor 124. As a result, when the drive motor 120 retracts the drive cable 132 by winding it on the winding rotor 124, the length of the drive cable between the drive motor 120 and the anchor rod 206 is reduced, and the drive arm pulley 130 (and the drive motor 120) is drawn towards the anchor rod pulley 208 (and the anchor rod 206). As a result, the stair top 108 is pulled towards the anchor rod 206, and the stair bottom 110 is raised towards the stowed position. The drive arms 122 effectively serve as levers which actuate the folding of the stair 102 in response to tension on the drive cable 132. Since the drive motor 120 is provided on the drive arms 122 rather than on the stair 102 itself, when the drive cable 132 is fully wound so that the stair 102 is in the stowed position and minimum distance is between the drive motor 120 and the anchor rod 206, the drive cable 132 does not interfere with the framing 200. The drive motor 120 will thus rest slightly above the framing 200, and slightly above the floor surface of the upper level, when the stair 102 is in its stowed position.

The drive motor 120 is preferably actuated by a key-driven, normally off, two-way switch (not shown) such that when a key is inserted and held turned in one direction or the other, the drive motor 120 will either raise or lower the stair 102. The use of the removable key helps to prevent unauthorized activation, and the normally off state of the switch helps to prevent driving of the drive motor 120 unless and until desired. Additionally, sensors 134 such as limit switches are preferably provided on at least one of the stair top 108 and the stair bottom 110 such that the sensors 134 detect when the stair bottom is in contact with the lower level (i.e., when the stair 102 is fully lowered), and when the stair top 108 is adjacent the top framing sill 204 (i.e., when the stair 102 is fully stowed). The sensors 134 preferably trigger a relay which momentarily cuts the power to the drive motor 120, or which reverses the polarity of the power supply to the drive motor 120, so that the user cannot tighten or unwind the drive cable 132 more than necessary to have the stair 102 reach its fully stowed or fully lowered state.

As a result of the foregoing arrangement, a user may readily raise or lower the entirety of the stair 102 between lowered and stowed positions, without the need to unfold segments of the stair 102 or otherwise manually fold down the stair 102. Since the stair 102 is not articulated or otherwise foldable between the pivot 116 and the floor, it is extremely sturdy and does not wobble as a user traverses the stair 102. Additionally, so long as the pivot 116 is spaced from the stair top 108 by one or more stair rungs 106, when the stair 102 is fully lowered, a short length of the stair 102 will extend above the framing 200, thereby allowing the user to grasp the stair siderails 104 and/or stair rungs 106 for at least some distance above the surface of the framing 200 and thereby assisting the user's ascent above the framing 200.

Note that a preferred version of the invention is shown and described above to illustrate possible features of the invention, and different versions of the invention having different features are possible. Following is an exemplary list of potential modifications that may be made to the foregoing version of the invention.

Initially, while not depicted in FIG. 1, the rear side 118 of the stair 102 preferably has a sheet of ceiling material situated across it such that when the stair 102 is folded into the stowed position, the stair 102 will visually blend into any surrounding ceiling provided on the lower surface of the framing 200. Additionally, depending on the use of the stairway 100, a sheet of insulating material may be interposed between the rear side 118 of the stair 102 and the sheet of ceiling material, or insulating material may be situated adjacent the sheet of ceiling material and between the stair rungs 106, to diminish heat loss through the stair 102 from the lower level to the upper level.

The stair siderails 104 and stair rungs 106 may be made of any suitable materials, such as wood, plastic, or metal, with formed sheet metal being particularly preferred for sake of high strength and low weight. It is useful to have the surfaces of the stair rungs 106 treated or coated to have relatively high-friction surfaces, at least on their top surfaces (show in FIG. 1), since these are the surfaces which will be primarily used by a user when traversing the stair 102. As an example, non-skid strips having rough surfaces may be adhered to the stair rungs 106 if desired.

The pivot 116 may also take forms other than the one depicted in FIG. 1; for example, the pivot 116 could consist of a single rod which extends through the stair 102 between and through both stair siderails 104, or the pivot 116 could take the form of virtually any other type of rotational joint.

The drive motor 120 may be also provided on the stair 102 in a variety of different arrangements. As an example, another particularly preferred version of the stowing stairway 100 involves extending a shaft between the drive arms 122, and pivotally hanging the drive motor 120 from the shaft by one or more loops or bands extending from the drive motor 120 and about the shaft. In this arrangement, when tension is exerted on the drive cable 132, the drive motor 120 pivots about the shaft as it is pulled towards the anchor rod 206, and the winding rotor 124 of the drive motor 120 orbits the shaft while remaining parallel to it. In this arrangement, the drive arm pulley 130 may also be pivotally hung from the shaft or drive motor 120, or may be rotatably situated on the shaft or the winding rotor 124.

While the anchor rod 206 is shown mounted between opposing framing sides 202, this arrangement would not allow flooring to be fully placed atop the framing sides 202 (and over the anchor rod 206) without interfering with the drive cable 132. It is instead possible to mount the anchor rod 206 between a pair of mounting blocks which are in turn mounted above the framing 200 (e.g., on any associated floor of the upper level), or to a wall in the upper level. It should also be understood that the anchoring of the drive cable 132 need not be provided by an anchor rod 206, and may instead be provided by anchoring the end of the drive cable 132 to any appropriate structure on the upper level adjacent to a anchor rod pulley 208.

Additionally, pulleys 130 and 208 need not be provided in all cases depending on the lifting capacity of the drive motor 120, and the drive cable 132 may simply be interposed between the drive motor 120 and any appropriate anchor provided on the upper level, with no pulleys situated therebetween. As yet another alternative, more pulleys 130/208 may be situated on the stair 102 and/or on the upper level to modify the lifting speed and force as desired.

The drive arms 122 can also be configured and mounted to the stair 102 in such a manner that they rest flush with the framing 200 (or any floor surface provided thereon) when the stair 102 is in the fully stowed position. The drive motor 120 can then be situated in the drive arms 122 in such a manner that it rests on (or even sunken within) any framing 200 or upper level floor surface. In this arrangement, when the stair 102 is stowed, the drive motor 120 is also effectively stowed at the upper level. If desired, a housing may be situated over the drive arms 122 and drive motor 120 which inhibits access to the drive motor 120 from the stair front side 114, and such a housing could cover the stowed drive motor 120 and could rest flush with the framing 200 (or floor surface thereon) when the stair 102 is stowed.

As another alternative, rather than providing the drive motor 120 on the stair 102 (and on its drive arms 122, if present), the drive motor 120 could instead be provided on the upper level, e.g. in place of the anchor rod 206, with the drive motor 120 driving a drive cable 132 which interacts with pulleys 130 and/or anchors on the stair 102. Simply stated, the drive motor 120 need not be on the stair 102, and may instead be situated on surrounding structure to drive the stair 102

The invention is not intended to be limited to the preferred versions of the invention described above, but rather is intended to be limited only by the claims set out below. Thus, the invention encompasses all different versions that fall literally or equivalently within the scope of these claims.

What is claimed is:

1. A stowing stair assembly comprising:

a. a stair including a pair of siderails with rungs extending between the siderails, the stair having a stair top and a stair bottom;

b. a pivot about which the stair pivots, the pivot being situated adjacent the star top and below the topmost rung;

c. a motor affixed to the stair top, the motor driving a cable leading to an anchor situated off the stair, whereby the motor's driving of the cable draws the stair top toward the anchor and thereby rotates the stair about the pivot to raise the stair bottom.

2. The stowing stir assembly of claim 1 further comprising a drive arm extending from the stair top, wherein the motor is situated on the drive arm spaced from the stair top.

3. The stowing stair assembly of claim 2 wherein the drive arm is oriented at least substantially vertically when the star bottom is fully lowered to rest on a floor.

4. The stowing stair assembly of claim 1 wherein the stair bottom is biased downwardly by gravity, and lowers downwardly toward a floor absent tension on the cable.

5. The stowing stair assembly of claim 1 wherein the cable is engaged by a pulley situated between the motor and the anchor.

6. The stowing stair assembly of claim 1 wherein:

a. the stair top bears a sensor thereon, and b the stair bottom bears a sensor thereon, the sensors being in communication with the motor.

7. The stowing stair assembly of claim 1 wherein the stair rungs are not articulated to allow the stair rungs to fold.

8. A stowing stair assembly comprising:

a. a stair having a stair top, an opposing stair bottom, and several rungs situated in spaced relationship therebetween;

b. a pivot upon which the stair is pivotally mounted, wherein at least one rung is situated between the pivot and the stair top;

c. an anchor in relation to which the stair pivots;

d. a cable affixed to the anchor;

e. a motor at the top of the stair which drives the cable and thereby rotates the stair about the pivot to raise and lower the stair bottom;

wherein the stair bottom is biased downwardly by gravity, and lowers downwardly toward a floor absent the driving action of the motor.

9. The stowing stair assembly of claim 8 further comprising a drive arm protruding from the stair top, wherein the motor is situated on the drive arm.

10. The stowing stair assembly of claim 9 wherein the drive arm is oriented at least substantially vertically when the stair bottom is lowered.

11. The stowing stair assembly of claim 8 wherein the cable is engaged by at least one pulley between the motor and the anchor.

12. The stowing stair assembly of claim 8 wherein:

a. the stair top bears a sensor thereon, and b. the stair bottom bears a sensor thereon, the sensors being in communication with the motor.

13. A stowing stair assembly comprising:

a. a stair having a stair top, an opposing stair bottom, and several rungs situated in spaced relationship therebetween;

b. a pivot interposed between a pair of rungs, the stair being pivotally mounted on the pivot, whereby the stair bottom may be raised and lowered in relation to the pivot;

c. a cable extending from the stair to an anchor situated off the stair; and d. a motor at the top of the stair which drives the cable, wherein driving of the cable raises and lowers the stair bottom about the pivot.

14. The stowing stair assembly of claim 13 further comprising a drive arm protruding from the stair top, wherein the cable extends from the drive arm.

15. The stowing stair assembly of claim 14 wherein the motor is situated on the drive arm.

16. The stowing stair assembly of claim 14 wherein the drive arm is oriented at least substantially vertically when the stair bottom is fully lowered to rest on a floor.

17. The stowing stair assembly of claim 13 further comprising at least one pulley engaging the cable.

18. The stowing stair assembly of claim 13 wherein:

a. the stair top bears a sensor thereon, and b. the stair bottom boars a sensor thereon, the sensors being in communication with the motor.

19. The stowing stair assembly of claim 13 wherein the stair bottom is biased downwardly by gravity, and lowers downwardly toward a floor absent tension on the cable.

20. The stowing stair assembly of claim 13 wherein the cable is engaged by a pulley situated between the motor and the anchor.

* * * * *